US005553968A

United States Patent [19]

Campbell

[11] Patent Number: 5,553,968

[45] Date of Patent: Sep. 10, 1996

[54] METHOD AND APPARATUS FOR CONVEYING AND DESEGREGATING AGGREGATE

[75] Inventor: Thomas R. Campbell, Chattanooga, Tenn.

[73] Assignee: Astec Industries, Inc., Chattanooga, Tenn.

[21] Appl. No.: 314,349

[22] Filed: Sep. 29, 1994

[51] Int. Cl.[6] ..... E01C 19/00

[52] U.S. Cl. ..... 404/108; 404/81; 198/537; 198/560; 198/569

[58] Field of Search ..... 404/81, 101, 108, 404/113, 110; 198/537, 560, 569; 209/693; 414/528

[56] References Cited

U.S. PATENT DOCUMENTS

| | | | |
|---|---|---|---|
| 3,621,976 | 11/1971 | Moore | 198/537 |
| 4,145,154 | 3/1979 | Mingot | 404/81 |
| 4,619,550 | 10/1986 | Jeppson | 404/108 X |
| 4,818,139 | 4/1989 | Brock et al. | 404/81 |
| 5,035,534 | 7/1991 | Brock et al. | 404/81 |
| 5,073,063 | 12/1991 | Brown | 404/101 |

FOREIGN PATENT DOCUMENTS

| | | | |
|---|---|---|---|
| 2536772 | 6/1984 | France | 404/108 |

OTHER PUBLICATIONS

J. Don Brock et al., *Segregation Causes and Cures,* Technical Paper T-117.

*Primary Examiner*—Michael Powell Buiz
*Assistant Examiner*—James A. Lisehora
*Attorney, Agent, or Firm*—Nilles & Nilles, S.C.

[57] ABSTRACT

An apparatus and method for desegregating and conveying aggregate. A drag slat conveyor has a notch in the floor of its discharge end which causes larger aggregate at the lateral edges of the conveyor to drop out of the conveyor after smaller aggregate located between the lateral edges. The larger and smaller aggregate are thereby reoriented from a side-by-side lateral orientation to a longitudinal orientation. The longitudinally oriented segregated aggregate may then be thoroughly desegregated in a second conveyor.

10 Claims, 3 Drawing Sheets

METHOD AND APPARATUS FOR CONVEYING AND DESEGREGATING AGGREGATE

BACKGROUND OF THE INVENTION

1. Field of the Invention

The present invention relates in general to methods and apparatus for desegregating aggregate. In particular, the invention relates to methods and apparatus for conveying and desegregating asphalt aggregate material from a delivery vehicle to a finishing machine.

2. Summary of the Prior Art

A. Prior Art Load Transfer Vehicles and Methods

The conventional method of laying an asphalt aggregate roadway mat includes the use of a finishing machine and a number of delivery tracks to transport the asphalt-aggregate material from the asphalt plant to the job site. Finishing machines of this type are called pavers and are well known to those skilled in the art. Such a finishing machine has a so-called floating screed at its rear end, usually provided with some form of vibratory means, to form the asphalt mat. The finishing machine also includes a hopper at its front end for receiving the asphalt aggregate material and suitable conveyor means, usually slat conveyors and screw augers, for delivering the material from the hopper to a position just in advance of the screed.

The technique for transferring the asphalt aggregate material from the dump truck to the hopper of the finishing machine normally requires the truck driver to position his vehicle immediately in front of the finishing machine, the latter being provided with rollers which engage the rear tires of the truck. During the time that the material is being transferred from the dump truck to the hopper of the finishing machine, the latter is advancing along the subgrade as it forms the asphalt aggregate mat and in doing so pushes the truck forwardly in tandem therewith.

A number of problems arise when operating the finishing machine and the delivery trucks in this manner. Quite frequently, the hopper of the finishing machine will be nearly empty but a loaded dump truck will not be available at the job site. When this occurs, the finishing machine must obviously stop and await the arrival of another delivery truck. When a finishing machine stops, even momentarily, the screed will tend to settle into the freshly laid mat. When the finishing machine then commences forward travel, the screed will tend to ride upwardly momentarily thus depositing an excessive amount of material. Consequently, such uneven surfaces are undesirable.

The failure of prior art methods to address this problem was addressed in U.S. Pat. No. 4,818,139 entitled "Methods and Apparatus for Making an Asphalt Aggregate Pavement." A self-propelled mobile apparatus is disclosed and claimed therein which has a large capacity hopper and a large capacity conveyor permitting a delivery dump truck to discharge its contents directly into the hopper in a rapid manner. The self-propelled vehicle may either shuttle between the finishing machine and a remote location of dump trucks, or travel in tandem with the finishing machine as the paving operation is performed. The self-propelled storage vehicle not only ensures that there will be a continuous supply of asphalt aggregate material to the screed of the finishing machine, but also remixes the asphalt aggregate in the large capacity hopper to desegregate it and thus improve pavement quality.

B. The Problem of Segregation

Segregation is a frequently recurring problem that has caused concern within the paving industry for decades and is receiving wide-spread attention by contractors, state highway departments, and equipment manufacturers. Segregation creates nonuniform mixes that do not conform to the original job mix formula. Segregation in a mixture results in a concentration of coarse materials in some areas of the paved mat, while other areas contain a concentration of freer materials. The resulting pavement exhibits poor structural and textural characteristics and has a shorter life expectancy. Elimination of segregation is essential to the production of high-quality paving mixtures. Segregation can be reduced by employing proper mix design. Mixes that are uniformly designed with no gap grading are generally very forgiving. However, gap graded mixtures are very unforgiving and in some cases simply cannot be produced without segregation occurring regardless of the techniques used.

Proper stock-piling techniques can also reduce segregation. Large stock piles are very sensitive to single aggregate blends. If the stock pile is formed using a conveying system, large particles roll to the outside of the pile causing segregated material to be fed to the plant. This problem can be reduced by making numerous piles of the aggregates rather than one large pile. But segregation can occur at numerous other points at a hot mix asphalt plant such as in cold-feed bins, hot bins on a batch plant, in the drum mixer, surge and storage bins, and during truck loading and unloading. Due to rapid truck loading underneath surge or storage bins at the plant, truck drivers often tend to pull the truck under the bin and not move it during loading. If the mix is sensitive to segregation, larger stones will roll to the front of the truck, to the rear, and to the sides as it would in a stock pile on the ground.

When unloading the truck into a paver hopper segregation again occurs, as coarse material accumulates at the outside portion of the paver wings. The use of a material transfer vehicle such as that disclosed in the above-referenced U.S. Pat. No. 4,818,139, overcomes the segregation problems that occur when material is unloaded from a dump truck into a paver, thus ensuring smooth pavement. Variable pitch augers in the bottom of the holding hopper remix and reblend the material as it discharges into the rear discharge conveyor. The reblended and remixed material is fed to the paver as the mat is being laid. Material transfer vehicles like this have one drawback: they are very large and more expensive. A compact vehicle which relatively inexpensively transfers material from a dump truck to the paver and at the same time eliminates segregation would be of great benefit.

SUMMARY OF THE INVENTION

The present invention resides in the provision of an apparatus that includes a first conveyor that conveys segregated material from a dump truck, further segregates and reorients it, and transfers it to a second conveyor where it is mixed and thereby desegregated. In the preferred embodiment of the invention, the apparatus is in the form of a self-propelled vehicle which may ride in tandem with a paver and at the same time receive supplies of aggregate from delivery trucks.

The preferred apparatus may be provided with a first conveyor which receives from a delivery truck material which naturally segregates as it is off loaded from the truck with the larger grade rolling to the lateral edges of the conveyor and the smaller grade therebetween. The first conveyor is provided with a floor at its end opposite the truck having a notch therein which allows the smaller aggregate in the center of the conveyor to exit the conveyor prior to the larger aggregate at the lateral sides of the conveyor. This sequence preferably causes the larger aggregate from each edge of the conveyor to combine and be further segregated from the smaller aggregate and to be reoriented 90° with respect to the smaller aggregate. Segregation and reorientation of the smaller and larger aggregate may be enhanced by a chute having a divider extending from the notched floor of the first conveyor and toward a second conveyor which divides the larger and smaller aggregate as they exit the first conveyor. As the larger and smaller aggregate exit the first conveyor and pass through the chute, their relative orientation is longitudinally along the conveyor instead of laterally. The longitudinally oriented and segregated smaller and larger aggregate are thoroughly desegregated when they come in contact with and are conveyed along a second conveyor to a paving machine.

DESCRIPTION OF THE PREFERRED EMBODIMENT

Figures 1, 2:
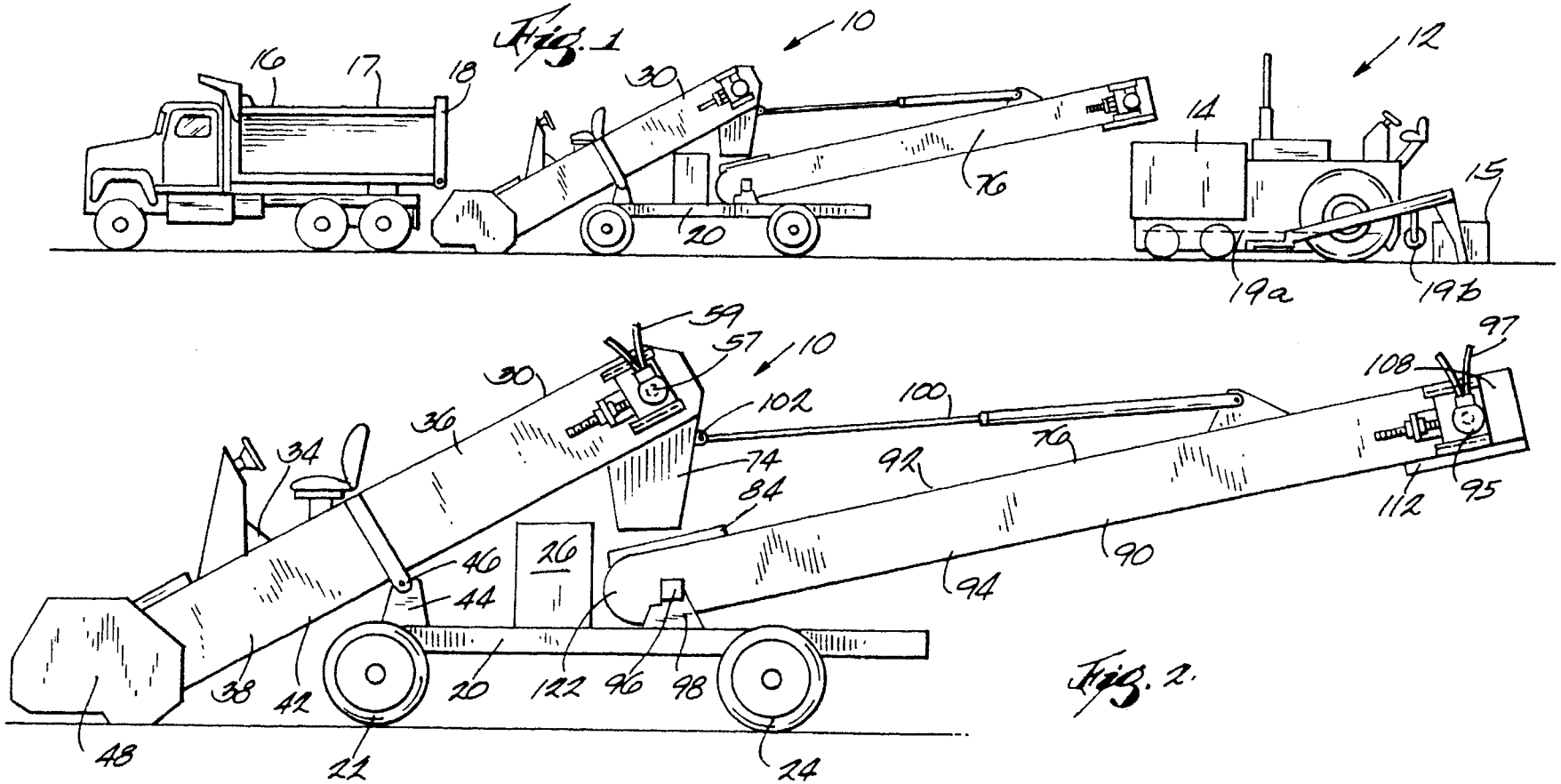
FIG. 1 is a schematic side elevation showing the preferred embodiment of the present invention in association with a delivery truck and a finishing machine.
FIG. 2 is an enlarged schematic side elevation showing the preferred embodiment of the present invention, i.e., a self-propelled transfer vehicle having first and second conveyors.

Referring to FIG. 1, a self-propelled load remixing transfer vehicle, constituting a preferred form of the apparatus of the present invention, is generally designated 10. The self-propelled vehicle is shown in association with a finishing machine, generally designated 12, and a delivery truck, generally designated 16. The delivery truck 16 is normally in the form of a dump truck having a pivotably mounted bed 17 with a tailgate 18. The truck 16 transfers the aggregate-asphalt material from a remote source to the vehicle 10 as will be explained below.

The finishing machine 12 may be supported either by endless tracks or by rubber tires and includes a hopper 14 and a vibratory screed 15 which may be of the floating type well known to those skilled in the art. The finishing machine also includes a conventional conveyor system consisting of longitudinally disposed conveyors 19*a* (shown in broken line) and transversely disposed screw augers 19*b* for delivering the asphalt aggregate material from the hopper 14 to a position just in advance of the screed 15 where it is discharged onto the subgrade.

Referring more particularly to FIG. 2, the self-propelled transfer vehicle 10 includes a chassis 20 that is supported on the roadway surface by first and second wheel sets 22 and 24 respectively. The from wheel set 22 is steerable. It will be understood that alternative roadway engaging means, such as endless tracks, could be used in place of the wheel sets 22 and 24. The self-propelled vehicle is propelled by a hydrostatic drive system consisting of individual hydraulic motors (not shown) that are supplied with fluid pressure from hydraulic pumps. An engine 26 provides the motive force for the pumps as is conventional in hydraulic drive systems. The drive system, in its essentials, is as disclosed in U.S. Pat. No. 4,818,139 ('139 patent) which is incorporated herein by reference.

The self-propelled vehicle 10 further includes an operator's platform 34 which may comprise one or two identical operator control stations that may be swung back and forth to facilitate operating the self-propelled vehicle in both directions. The operator's platform, in its essentials, is as disclosed in the '139 patent.

A truck unloading conveyor 30 is affixed to the front end of vehicle 10 and is a high capacity loading conveyor, preferably of the drag-slat type comprising a frame 36 having side members 38. The conveyor 30 is pivotably mounted to vertical support 44 at pivot point 46. Thus, the conveyor 30 can be swung vertically about the pivot point 46 between an upper transport position (not shown) and a lower loading position shown in FIG. 2. The swinging movement of the conveyor 30 may be provided by a pair of hydraulic cylinders (not shown) or other motive device. The conveyor 30, in its essentials, is as disclosed in the '139 patent.

The conveyor 30 may also have affixed to it a trough 48 adapted to abut the back end of supply truck 16 during the truck unloading operation. The trough is preferably approximately as wide as the dump truck such that asphalt aggregate material can quickly and easily be dumped from the truck 16 into the trough 48. As in the '139 patent, the trough may be expanded by use of a pair of adjustable screw thread assemblies such that the size of the trough infeed opening can be varied to regulate the flow of material into the conveyor 30.

Figure 3:
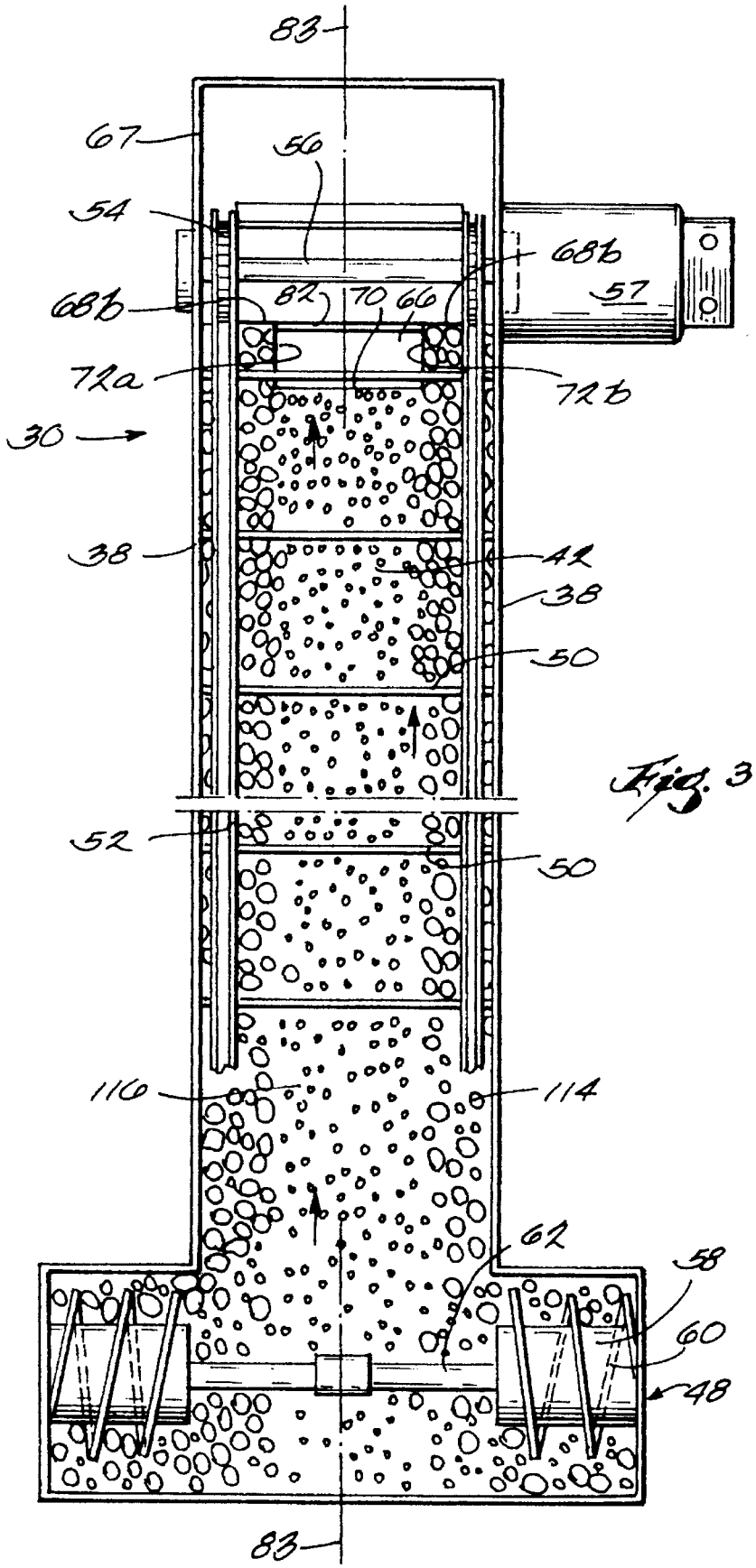
FIG. 3 is a schematic top plan view of the first conveyor of the self-propelled apparatus of the present invention.
Figure 4:
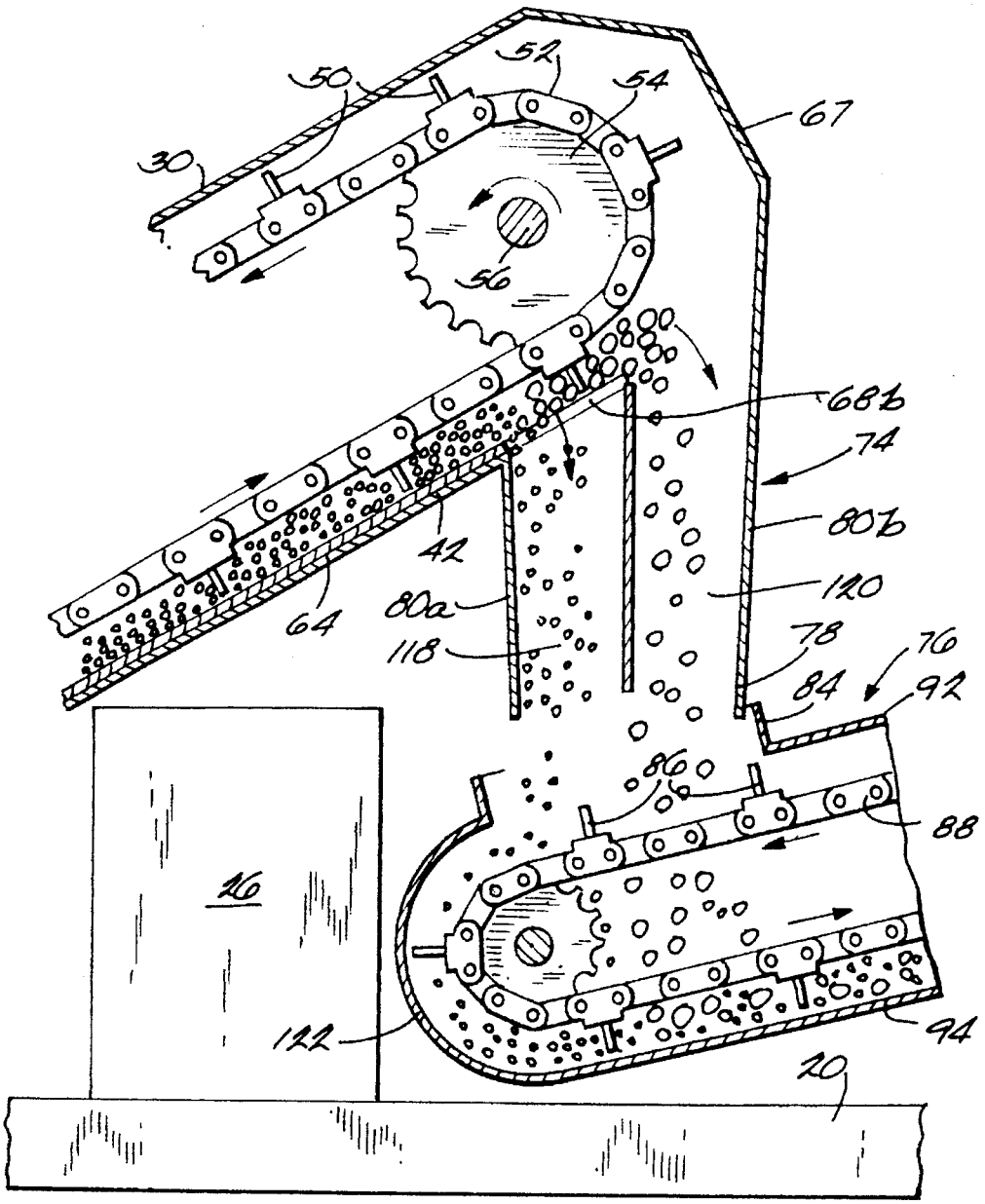
FIG. 4 is an enlarged schematic side elevation showing the further segregated aggregate being reoriented and transferred from the first conveyor to the second conveyor and being mixed and desegregated in the second conveyor.

As seen in FIG. 4, the drag slat conveyor within the frame 38 has slats 50 mounted on endless chain 52 meshing with sprocket 54 mounted on shaft 56 mounted for rotation in frame 38. Shaft 56 is driven by hydraulic motor 57 having hydraulic hoses 59, and powered by engine 26 as best seen in FIG. 2. As best seen in FIG. 3, the trough 48 at the loading end of the conveyor 30 has rotatably mounted therein an auger 58 having flights 60 mounted on shaft 62 as is described in detail in the '139 patent. As best seen in FIG. 4, a floor 42 of the truck unloading conveyor 30 is protected with a Ni hard liner 64 due to the highly abrasive action of the aggregate passing thereover from the lower loading end to the upper discharge end of the conveyor 30. As seen in FIG. 3, the floor 42 has a notch 66 therein near the upper or discharge end 67 of the conveyor 30. The notch may be approximately half as wide as the width of the conveyor and is preferably centered in the floor 42 of the conveyor 30. The notch, in the preferred embodiment, is approximately 14" deep. The lateral sides 68*a* and 68*b* thus extend approximately 14" further toward the shaft 56 at the upper or discharge end 67 of the conveyor 30 than does the forward edge 70 of the notch. The notch has lateral edges 72*a* and 72*b*. The dimensions of the notch may be varied depending on aggregate characteristics and machine size.

At the notch 66, the discharge end 67 of the conveyor 30 has no floor and remains open so that materials conveyed along the conveyor 30 may drop out. In the preferred embodiment, the materials drop out into a chute 74, having side walls 80*a* and 80*b*, which may be rigid or may be made of rubber or other flexible material fastened to the end 67 of the conveyor 30 to direct aggregate dropping therefrom down and into mixing conveyor 76. The exact dimensions of the chute are unimportant except that it should be sufficiently sized to permit free flow of aggregate therethrough and onto the mixing conveyor 76. The chute is also preferably of reduced diameter or "choked" at its lower end 78 to better control aggregate falling therethrough. Chute 74 also has a divider 82 extending downwardly at approximately the middle of the chute as viewed from the side and top. The divider 82 is positioned to hang downwardly from, and between, and at the rear edge of, the lateral sides 68*a* and 68*b* of the floor 42 of the truck unloading conveyor 30. The divider should be mounted so as to be able to withstand the constant flow of aggregate dropping from the conveyor 30. The divider may simply comprise a flat sheet of heavy duty rubber or other suitable material mounted transverse to the longitudinal axis 83 of the conveyor 30.

Aggregate falling through the chute 74 falls through an inlet shroud 84 on the mixing conveyor 76. The relative size of the lower end 78 of the chute 74 and the inlet shroud 84 of the second conveyor 76 is preferably such that no or very little aggregate is lost as waste outside the inlet shroud 84. Mixing conveyor 76 may also preferably be of the drag slat type having slats 86 on endless chain 88, side walls 90, top 92, and floor 94. Mixing conveyor 76 is driven by a hydraulic motor 95 having hydraulic hoses 97, and driven by engine 26. Details of the construction of the conveyor 76 are provided in the '139 patent referenced above. The conveyor 76 is mounted for pivotal movement about shaft 96 which is mounted on trunion 98. The conveyor 76 thus is able to pivot vertically as well as swing horizontally about trunion 98. The conveyor 76 may be raised and lowered and swung via a winch arrangement generally indicated at 100 or a hydraulic cylinder arrangement (not shown) or other motive device as described in the '139 patent. Winch arrangement 100 is mounted at a first pivot point 102 on the end of the conveyor 30 and a second pivot point 104 mounted to a support 106 at the outfeed or discharge end 108 of the conveyor 76. In order to keep the weight of the conveyor 76 low, the side walls 90 and top 92 of the conveyor 76 should be kept as thin as possible. An outlet shroud 112 is provided at the end 108 of the conveyor 76. Aggregate dropping out of the conveyor 76 through outlet shroud 112 drops into hopper 14 of finishing machine 12.

Unlike the self-propelled storage vehicle of the '139 patent which is able to store large quantities of asphalt aggregate and shuttle back and forth between delivery trucks and paver, the self-propelled vehicle 10 of the present invention does not have large storage capability and therefore preferably remains in tandem with the paver 12 while delivery trucks 16 empty their loads into the trough 48 as the paver 12 and self-propelled vehicle 10 move forward (to the left in FIG. 1). The self-propelled vehicle 10 performs primarily conveying and remixing functions to transfer and desegregate materials that have segregated naturally during delivery and unloading into the trough 48. Without the self-propelled remixing vehicle 10, the delivery trucks would necessarily dump the asphalt aggregate directly into the hopper 14 of the paver 12 which asphalt aggregate would naturally segregate in the paver hopper 14 and yield unsatisfactory pavement. With the self-propelled vehicle 10, delivery trucks empty their load into the trough 48 of the truck unloading conveyor 30 and even though segregation will occur in the trough 48 (as it would if dumped in the hopper 14 of the paver) the vehicle 10 is able to provide the paver 12 with desegregated material by reorienting and further segregating the aggregate in conveyor 30 and then remixing it in conveyor 76 as follows.

The self-propelled vehicle 10 travels in tandem with the paving machine 12. The outfeed end 108 of the conveyor 76 is positioned and remains over the hopper 14 of the paving machine. Because the conveyor 76 may be swung from side to side, the load remixing transfer vehicle 10 need not be directly in front of the paving machine 12 but may be positioned to one side or the other. A delivery truck 16 carrying asphalt aggregate material backs up to the trough 48 and begins emptying its asphalt aggregate load material into the trough. As the transfer of asphalt aggregate from the truck 16 to the trough 48 takes place, larger aggregate rolls off to the lateral sides of the trough 48 leaving the smaller aggregate in the center of the trough as seen in FIG. 3. The larger aggregate is generally designated 114 and the smaller aggregate, predominantly positioned therebetween, is generally designated 116. As the truck unloading conveyor 30 conveys the asphalt aggregate material out of the trough 48, the larger aggregate 114 remains towards the lateral edges of the conveyor 30 and the smaller aggregate 116 remains therebetween. The asphalt aggregate material then is carried upwardly by the slats 50 carried by the endless chain 52 against the Ni hard liner 64 on the floor 42 of the conveyor 30. As the asphalt aggregate reaches the upper or discharge end 67 of the conveyor 30 it drops off into the chute 74. In a conventional conveyor-to-conveyor transfer, the segregated aggregate would remain segregated as it dropped off the first conveyor and onto the lower second conveyor, with the larger aggregate 114 remaining at the lateral sides of the conveyor and the smaller aggregate 116 therebetween. Of course, some mixing would occur as the aggregate strikes the endless chain and slats of the second conveyor, but the segregation would remain predominantly the same as on the first conveyor.

In the present invention, the presence of the notch 66 in the floor 42 of the conveyor 30 causes the smaller aggregate 116 to drop out of the conveyor 30 prior to the larger aggregate 114. The distance that the larger aggregate 114 travels along the floor 42 of the conveyor 30 (as measured from the trough 48) is approximately 14" greater than the path of travel of the smaller aggregate 116 in the conveyor 30. This causes the smaller aggregate 116 to drop off into a forward portion 118 of the chute 74 between the divider 82 and the chute sidewall 80*a* and nearest the trough 48. Concurrently, because the lateral sides 68*a* and 68*b* of the floor 42 of the conveyor 30 are extended 14" beyond the edge 70 of the notch, the larger aggregate 114 falls into a rearward region 120 of the chute 74 distant from the trough 48. Thus, it can be seen that the simple notch 70 causes the otherwise laterally separated streams of larger aggregate 114 at the lateral edges of the conveyor 30 to be combined into a common flow of coarse aggregate in rearward region 120. In addition to combining the otherwise separated flows of large aggregate, the notch 70 and complimentary lateral sides 68*a* and 68*b* reorient the relative positions of the larger and smaller aggregate by 90° so that the larger and smaller aggregate are aligned along the longitudinal axis 83 of the conveyor 30 rather than being side by side. Thus, the prior natural segregation in the conveyor 30 is erased and thorough mixing occurs in the conveyor 76 as larger aggregate in rearward region 120 of chute 74 and smaller aggregate in forward region 118 drop into inlet shroud 84 and onto endless chain 88 and are propelled rearward by slats 86. As is seen in FIG. 4, some of the aggregate falls through the chain 86 and onto the floor 94 of the second conveyor 76 enhancing mixing and some is carried on top of the endless chain 88 and around the rear and lower end portion 122 of the conveyor 76. By the time the aggregate is conveyed toward the rear and upper discharge end 108 of the conveyor 76 and out the outlet shroud 112, it is thoroughly remixed and desegregated. Thus, the asphalt aggregate material dropping into the hopper 14 of the finishing machine 12 will provide a quality asphalt mat.

It should be understood that embodiments of the present invention not disclosed herein are fully intended to be within the scope of the appended claims.

I claim:

1. An apparatus for remixing and conveying aggregate that has been segregated into smaller and larger aggregate, said apparatus comprising:

a. a first conveyor having a receiving end, a discharge end, and edges;

b. a second conveyor having a receiving end and a discharge end, said receiving end of said second conveyor being positioned adjacent said discharge end of said first conveyor;

c. said discharge end of said first conveyor having a floor, said floor extending from said receiving end to said discharge end, said floor including a notch at said discharge end and located laterally between said edges, said floor having lateral side portions on either side of said notch, said first conveyor carrying said larger aggregate predominantly along said lateral side portions of said floor and said smaller aggregate therebetween in laterally-oriented segregation, and wherein, in use, said notch causes said smaller aggregate to travel a shorter distance along a longitudinal axis of said first conveyor before being discharged than said larger aggregate and thereby reorients said larger and smaller aggregate from a laterally-oriented segregation to a longitudinally-oriented segregation.

2. The apparatus as defined in claim 1 further comprising a chute, said chute being attached to said discharge end of said first conveyor and having first and second portions separated by a divider.

3. The apparatus as defined in claim 2 wherein said first and second portions of said chute are aligned along said longitudinal axis.

4. An apparatus for remixing and conveying aggregate that has been segregated into larger and smaller aggregate, said apparatus comprising:

a. a first conveyor having a lateral axis and a longitudinal axis, said first conveyor carrying said segregated larger and smaller aggregate side-by-side along said lateral axis;

b. means for discharging said segregated aggregate from said conveyor so that said larger and smaller aggregate are discharged and reoriented approximately 90° from said lateral axis to said longitudinal axis; and a second conveyor, the second conveyor mixing the discharged and reoriented aggregate.

5. The apparatus as defined in claim 4 wherein said first conveyor includes a floor, said floor having a notch which permits smaller aggregate to discharge from said conveyor prior to said first larger aggregate.

6. The apparatus as defined in claim 4 further comprising a chute having a divider defining first and second portions of said chute, said first portion receiving said smaller aggregate and said second portion receiving said larger aggregate, said chute discharging said smaller aggregate and said larger aggregate into said second conveyor where said smaller aggregate and said larger aggregate are desegregated.

7. The apparatus as defined in claim 4 wherein said first conveyor is a first drag slat conveyor.

8. The apparatus as defined in claim 7 wherein said second conveyor is a second drag slat conveyor.

9. An apparatus for remixing and conveying aggregate that has been segregated into smaller and larger aggregate, said apparatus comprising:

a. a first conveyor having a longitudinal axis, a lateral axis, and lateral sides, said first conveyor carrying said larger aggregate predominantly at said lateral sides and said smaller aggregate therebetween in laterally-oriented segregation;

b. said first conveyor including a floor, said floor having a notch between said lateral sides, said notch causing said smaller aggregate to travel a shorter distance along said longitudinal axis of said conveyor before being discharged than said larger aggregate and thereby reorienting said larger and smaller aggregate from said laterally-oriented segregation to a longitudinally-oriented segregation;

c. a mixer which mixes and desegregates said longitudinally-segregated aggregate.

10. An apparatus for remixing and conveying aggregate that has been segregated into smaller and larger aggregate, said apparatus comprising:

a. a first conveyor having a longitudinal axis, a lateral axis, and lateral sides, said first conveyor carrying said larger aggregate predominantly at said lateral sides and said smaller aggregate therebetween in laterally-oriented segregation;

b. said first conveyor including a floor, said floor having a notch between said lateral sides, said notch causing said smaller aggregate to travel a shorter distance along said longitudinal axis of said conveyor before being discharged than said larger aggregate and thereby reorienting said larger and smaller aggregate from said laterally-oriented segregation to a longitudinally-oriented segregation;

a mixer which mixes and desegregates said longitudinally-segregated aggregate, said mixer comprising a drag slat conveyor having an endless chain and slats connected thereto, said longitudinally-oriented segregated aggregate contacting a top portion of said chain and falling therethrough and being conveyed on a bottom portion of said chain along said drag slat conveyor.

* * * * *